United States Patent [19]

Fisher et al.

[11] 4,354,825

[45] Oct. 19, 1982

[54] METHOD AND APPARATUS FOR DRYING COAL

[75] Inventors: Donald L. Fisher, Milton; Thomas B. Kearns, Danville; Edward T. Maciejewski, Catawissa, all of Pa.

[73] Assignee: McNally Pittsburg Mfg. Corp., Pittsburg, Kans.

[21] Appl. No.: 236,250

[22] Filed: Feb. 20, 1981

[51] Int. Cl.[3] ..... F23G 5/04; F27B 15/00; F26B 15/12

[52] U.S. Cl. ..... 432/14; 110/224; 432/15; 432/16; 432/19; 432/58; 432/72

[58] Field of Search ..... 432/14, 15, 16, 17, 432/19, 58, 72; 110/224

[56] References Cited

U.S. PATENT DOCUMENTS

| | | | |
|---|---|---|---|
| 2,638,684 | 5/1953 | Jukkola | 432/16 |
| 3,858,535 | 1/1975 | Shiba | 110/224 |
| 4,324,544 | 4/1982 | Blake | 432/14 |

FOREIGN PATENT DOCUMENTS

| | | | |
|---|---|---|---|
| 1526074 | 10/1969 | Fed. Rep. of Germany | 110/224 |

*Primary Examiner*—John J. Camby

*Attorney, Agent, or Firm*—Brumbaugh, Graves, Donohue & Raymond

[57] ABSTRACT

A method and apparatus for drying coal in which the coal is dried by a hot gas and then quickly cooled with ambient air to reduce the oxidation rate and in which the air heated in the cooler is supplied to support the combustion that generates the hot gas. The drying gas exhausted from the dryer is utilized to extract coal product, to produce the fuel necessary to generate the hot drying gas and to provide a tempering gas to help maintain the combustor within a desired temperature range. Condensation of the exhaust drying gas is prevented by utilizing the hot gas discharged from the combustor, bypassing the dryer, and supplying it to the exhaust gas at a plurality of different points.

28 Claims, 1 Drawing Figure

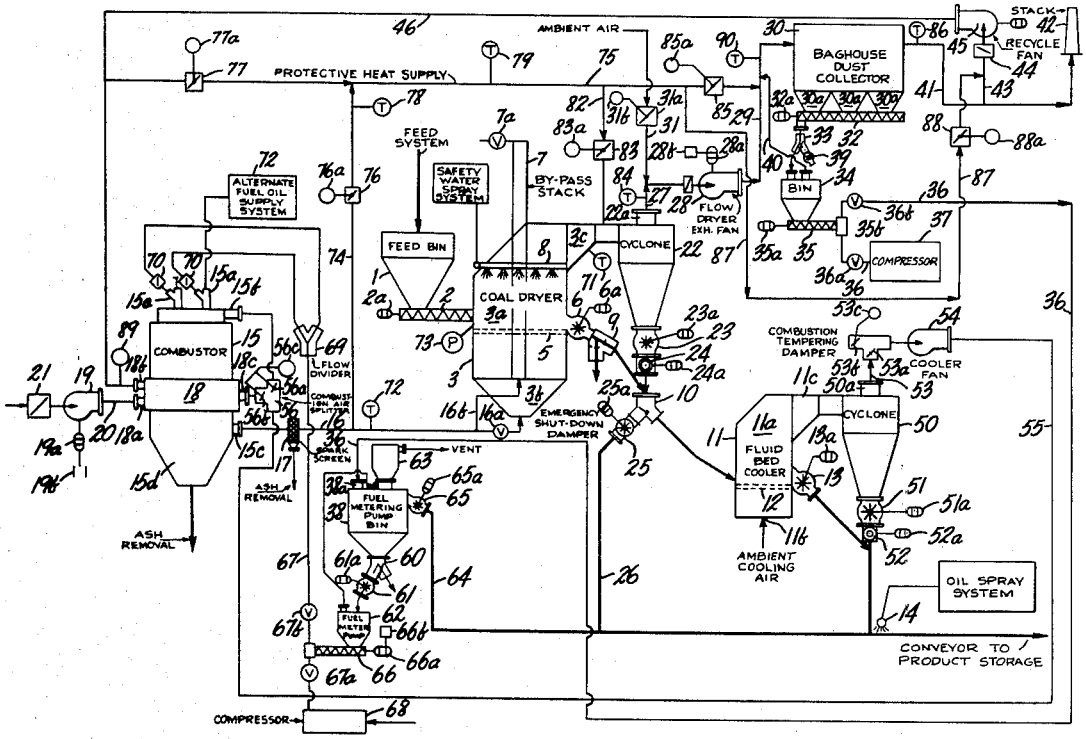

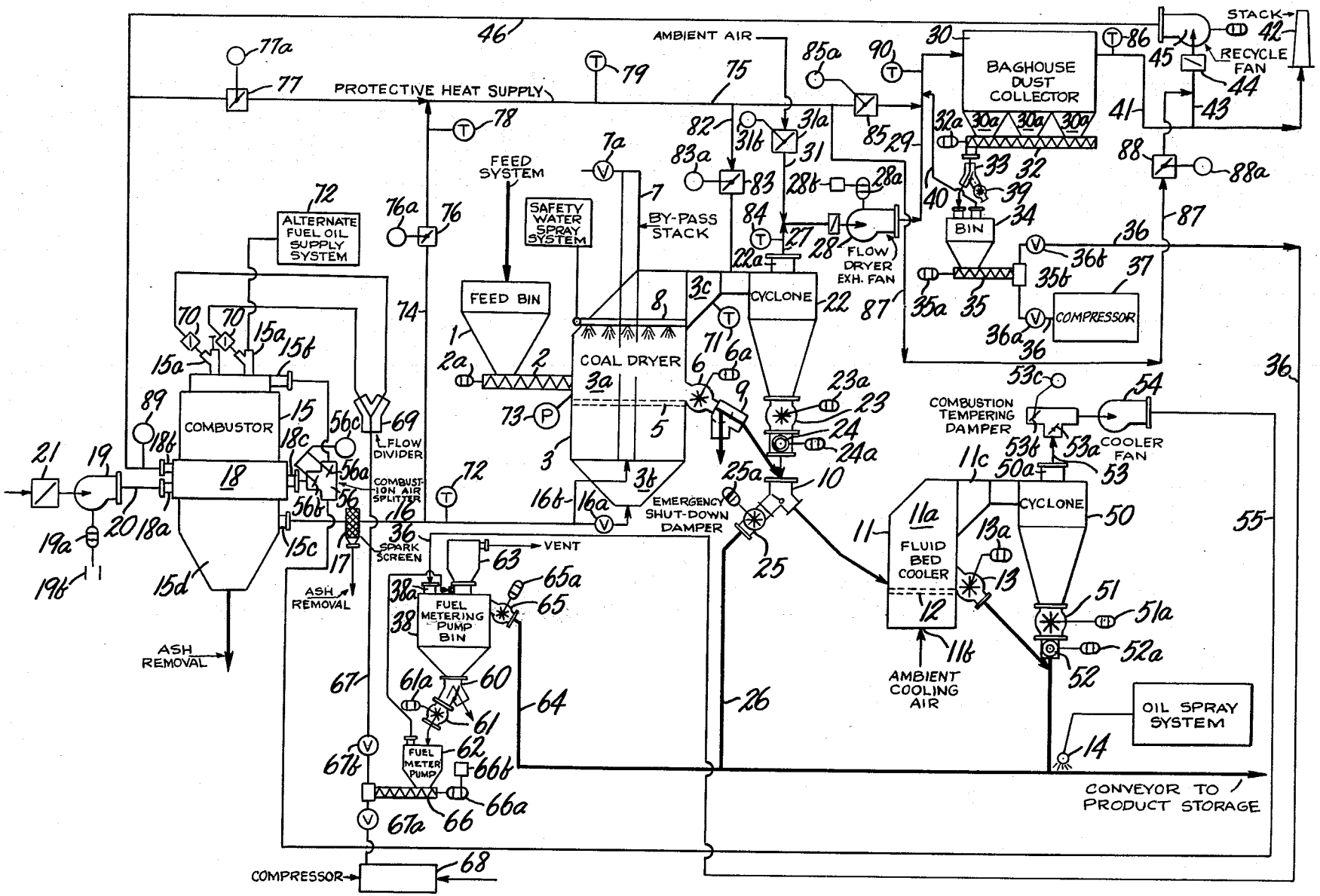
STACK
RECYCLE FAN
BAGHOUSE DUST COLLECTOR
BIN
COMPRESSOR
COOLER FAN
COMBUSTION TEMPERING DAMPER
CYCLONE
OIL SPRAY SYSTEM
CONVEYOR TO PRODUCT STORAGE
FLUID BED COOLER
AMBIENT COOLING AIR
FLOW DRYER EXH. FAN
CYCLONE
AMBIENT AIR
BY-PASS STACK
COAL DRYER
EMERGENCY SHUT-DOWN DAMPER
SAFETY WATER SPRAY SYSTEM
FEED SYSTEM
FEED BIN
VENT
FUEL METERING PUMP BIN
FUEL METER PUMP
PROTECTIVE HEAT SUPPLY
FLOW DIVIDER
COMBUSTION AIR SPLITTER
SPARK SCREEN
ASH REMOVAL
ALTERNATE FUEL OIL SUPPLY SYSTEM
COMBUSTOR
ASH REMOVAL
COMPRESSOR

METHOD AND APPARATUS FOR DRYING COAL

This invention relates to a method and apparatus for drying coal to remove moisture, increase stability and produce a superior fuel product. Although the method and apparatus are particularly applicable to the production of a superior fuel product from high moisture coals prone to oxidation and spontaneous combustion, for example, subbituminous and lignite coals, the invention has general application to a coal drying system.

Coal drying systems for removing surface moisture from high moisture coals have included coal dryers through which the coal is fed in heat exchange relationship with hot gas from a combustor. In one such prior art drying system a layer of coal is fed through a coal dryer across a downwardly sloped grate through which an upward flow of hot gas passes so that the upward flow of hot gas not only dries the coal passing across the grate but it fluidizes the coal and moves the coal toward the discharge end of the grate. This prior art coal drying system also includes means for extracting the coal particles and dust from the hot gas exhausted from the coal dryer for use as a fuel product.

The coal drying method and apparatus of the present invention relates to an improved coal drying system which is far less hazardous and more efficient and economical than the prior art coal drying system described above. To dry high mositure coals effectively, it is desirable to raise the temperature of the coal to as high a level as is possible, for example, near 200° F., without causing combustion. At these high temperatures the coal oxidizes rapidly and this can bring about spontaneous combustion. In the coal drying system of the present invention, provision is made for quickly cooling the dried coal to a temperature of about 100° F. or lower, or within about 30° F. of the temperature of the ambient air, to slow the oxidation rate significantly and thereby greatly decrease the risk of fire. This quick cooling is accomplished by introducing the dried coal directly into a coal cooler in which the coal is cooled by ambient air, and the heated ambient air is then utilized to support the combustion which generates the drying gas. This coal cooler not only reduces the hazard associated with prior art coal drying systems, but it contributes to the efficient operation of the system.

Another feature of the coal drying system of the present invention is that the drying gas exhausted from the dryer is efficiently utilized to extract coal product, to produce the fuel necessary to generate the hot drying gas and to provide a tempering gas to help maintain the combustor within a desired temperature range. Toward this end, the exhaust drying gas is passed through a primary separator to remove the coal product which is returned to the product stream, then passed through a secondary separator which removes the fine coal product which is metered to the combustor as fuel and then in part recycled back to the combustor for use as a tempering medium.

A further feature of the coal drying system of the present invention is that it has provision for preventing condensation of the exhaust drying gas by utilizing the hot gas discharged from the combustor and directing it through a conduit which bypasses the coal dryer into the dryer exhaust gas, preferably at a plurality of different points, to supply additional heat to the exhaust gas to prevent condensation. Introducing this heat supply to the dryer exhaust gas stream at several points will supply the added heat as it is needed, minimize the risk that the exhaust gas will be overheated and decrease the risk of an explosion.

Still another feature of the coal drying system of the present invention is that provision is made for utilizing part of the dryer exhaust gas recycled to the combustor to temper the hot gas which supplies the heat to prevent condensation of the dryer exhaust gas.

These and other features and advantages of the method and apparatus of drying coal of the present invention will be apparent from the detailed description of the invention which follows and by reference to the accompanying drawing in which the invention is shown in schematic form.

In the coal drying system of the present invention, the coal to be processed is fed from a bin 1 through a screw-type conveyor 2 to a coal dryer 3. The conveyor is driven by a variable speed motor 2*a*.

The coal dryer is conventional and contains a drying chamber 3*a*, a lower inlet 3*b* through which hot drying gas is introduced into the drying chamber and an upper exhaust 3*c*. The conveyor feeds the coal to be dried onto a porous grate 5 which is sloped slightly downwardly across the drying chamber to the intake of a rotary air lock 6 driven by a motor 6*a*. As the hot gas is pulled upwardly through the grate and from the dryer, the layer of coal on the grate is fluidized, causing the coal to move down the slope of the grate for discharge into the rotary air lock. Fluidizing the coal in the hot gas stream heats the coal and dries it to a controlled moisture level.

In drying high moisture content sub-bituminous and lignite coal, the coal is heated to a relatively high temperature, but less than the temperature that will cause spontaneous combustion. As mentioned above, dried coal of these types oxidizes rapidly at temperatures near 200° F. so that in drying these types of coal the drying temperature should be maintained below the combustion temperature. The hot gas leaves the dryer at about 50° F. above the discharge temperature of the coal.

The coal dryer 3 contains a stack 7 through which hot gas can be bypassed in the event of an emergency. A closed valve 7*a* normally prevents discharge from the stack, but the valve can be opened in the event of an emergency, such as fire in the drying chamber that requires shut-off of the heat entering the dryer. Heat from the combustor would also be directed to the bypass stack 7 in the event of a power failure to protect the dryer and other system components from damage due to high temperature. The upper region of the coal dryer also includes a safety water spray system 8 which can be activated in the event that the coal is heated above the ignition temperature.

The dried coal passes from the air lock 6 through a series of bypass diverters 9 and 10 to a fluid bed cooler 11 which quickly cools the coal to about 100° F. or less to slow the oxidation rate significantly. The bypass diverter 9 can be actuated to divert the coal discharged from the dryer to a hot coal bin. The temperature of the coal leaving the dryer is monitored, and when an excessively high temperature is sensed, indicating that the coal is on fire, the diverter is activated to bypass the coal to the hot coal bin.

The fluid bed cooler 11 contains a cooling chamber 11*a*, an inlet 11*b* at the lower end for admitting ambient cooling air to the chamber and an upper discharge 11*c*. The dried coal is discharged onto a porous grate 12 which is sloped slightly downwardly toward a rotary air lock 13 driven by a motor 13*a*. As the ambient air is pulled upwardly through the grate, the layer of coal on the grate is fluidized, as in the coal dryer, causing the coal to move down the slope of the grate for discharge into the rotary air lock. After the coal is cooled, it is carried by a conveyor beneath a sprayer 14 which sprays the coal with a coating of oil to decrease the oxidation rate. The oil spray also reduces the tendency of the coal to dust. The cooled and oil-sprayed coal is then conveyed to a burner or a product storage station.

The hot drying gas is supplied to the coal flow dryer 3 by a combustor 15. The combustor 15 has a pair of fuel supply inlets 15*a* and an air supply inlet 15*b* which admit the air and fuel necessary to maintain combustion within the combustor. The hot drying gas is discharged through an outlet 15*c* and passes through a conduit 16 to the inlet 3*b* of the coal flow dryer. A normally open valve 16*a* admits the hot gas into the inlet, but in the event of fire or other emergency in the coal dryer chamber 3*a* the valve 16*a* is closed and the valve 7*a* is opened to flow the hot gas from the combustor through the dryer chamber bypass 16*b* for exhaust through the stack 7. Ash is removed from the combustor through the lower discharge end 15*d* thereof. The conduit 16 contains a spark screen 17 which removes sparks, particulate material and ash.

The combustor 15 is encircled by an air bustle 18 to receive tempering air to cool the combustor, and the inner end of the air bustle communicates with the combustion chamber to supply additional air to complete combustion within the combustor. The air bustle contains inlets 18*a*, 18*b* and 18*c* which carry the tempering air in heat exchange relation with the combustion chamber before introducing it into the combustion chamber. Tempering air is supplied to the inlet 18*a* from a fan 19 through a conduit 20. The fan 19 is driven by a motor 19*a* controlled by a variable speed regulator 19*b*, and the air intake to the fan is controlled by an intake valve 21. The tempering air supplied to the inlet 18*b* is air recycled from the coal dryer 3, and the tempering air supplied to the inlet 18*c* is ambient air preheated in cooling the dried coal in the fluid bed cooler 11.

The exhaust from the discharge 3*c* of the coal dryer must be cleaned of entrained coal particles and dust. This exhaust passes through a primary separator or cyclone 22 where the coarse coal particles are removed from the bottom of the separator through a rotary air lock 23 driven by a motor 23*a*. The coarse coal particles are then fed by a screw-type conveyor 24 driven by a motor 24*a* to the bypass diverter 10 where it rejoins the dried coal fed to the cooler 11. The by-pass diverter 10 can be actuated to by-pass the fluid bed cooler and feed the dried coal through a rotary air lock 25 driven by a motor 25*a* and a conduit 26 directly to the conveyor which carries the coal through the oil spray 14 to the burner or product storage station.

The exhaust gas from the coal dryer is discharged from the primary separator or cyclone 22 through an upper outlet 22*a* and a conduit 27 by a flow dryer exhaust fan 28. The fan 28 induces the flow of the hot drying gas through the coal dryer 3 and the primary separator or cyclone 22 and delivers the dryer exhaust through a conduit 29 to a secondary separator or baghouse dust collector 30 which is a dry fabric filter which removes the fine coal dust from the hot gas discharged from the coal dryer 3. The rate of discharge of the exhaust from the cyclone 22 is regulated by a valve 27*a* in the conduit 27. Emergency tempering air can be introduced into the hot gas discharged from the coal dryer 3 through an intake conduit 31 containing a valve 31*a* regulated by the temperature of the gas entering the baghouse.

The coal dust removed from the hot gas by the secondary separator baghouse 30 is discharged through chutes 30*a* into a screw-type conveyor 32 driven by a motor 32*a* through a by-pass diverter 33 to a bin 34 of a penumatic transfer pump. The coal dust is then fed through a screw-type conveyor 35 driven by a motor 35*a* to a discharge 35*b* which introduces the coal dust into a pneumatic transfer conduit 36 pressurized by a compressor 37. The conduit 36 has valves 36*a* and 36*b* upstream and downstream, respectively, of the discharge 35*b* from the conveyor and delivers the coal dust to the inlet 38*a* of a fuel metering pump bin 38 from which the coal is fed, in a manner to be described below, as fuel for supporting combustion in the combustor 15. The coal dust can also be diverted from the bin 34 through a rotary air lock 39. Air from the bin can be vented through the baghouse by a return conduit 40 from the bin to the conduit 29.

The dedusted air is discharged from the baghouse dust collector by a conduit 41, and some or most of it is exhausted through a stack 42 to the atmosphere. A portion of it, about 40%, is recycled through a conduit 43, a control valve 44, a recycle fan 45 and a conduit 46 to the inlet 18*b* of the air bustle 18 of the combustor for use as a tempering fluid.

The exhaust from the discharge 11*c* of the cooler 11 must also be cleaned of entrained dust. This exhaust gas passes through a cyclone separator 50 where the coal particles and dust are removed from the bottom through a rotary air lock 51 driven by a motor 51*a*. The coal particles and dust removed are fed by a screw-type conveyor 52 driven by a motor 52*a* and returned to the mainstream of dried and cooled coal.

The exhaust from the cooler after the coal particles are separated is discharged through an upper outlet 50*a* of the cyclone through a conduit 53 by a cooler fan 54. The fan 54 delivers the cooler exhaust through a conduit 55 to the combustor air inlet 15*b* and/or the air bustle inlet 18*c* in proportions determined by the settings of valves 56*a* and 56*b* of an air splitter 56. The rate of flow of air induced through the fluid bed cooler 11 and exhausted from the cyclone 50 by the cooler fan 54 can be controlled by a valve 53*a*. Ambient air introduced into the conduit 55 can be controlled by a valve 53*b*.

The fuel metering pump bin 38 discharges the coal to be burned as fuel in the combustor 15 through a by-pass diverter 60 and a rotary air lock 61 driven by a motor 61*a* to a fuel metering pump 62. The diverter 60 can be actuated to divert the coal from the fuel metering pump for discharge or to a back-up fuel system. Unuseable dust is collected from the bin 38 and the pump 62 by a dust collector 63 through which air is vented to atmosphere. Excess fuel is discharged from the bin through a rotary air lock 65 driven by a motor 65*a* and returned to the mainstream of dried and cooled coal by a conduit 64.

The fuel metering pump 62 discharges the coal through a screw-type conveyor 66 driven by a motor 66*a* to a conduit 67 pressurized by a compressor 68. The conduit 67 contains a valve 67*a* upstream of the conveyor discharge and a valve 67*b* downstream of the conveyor discharge and supplies the fuel through a flow divider 69 to the fuel supply inlets 15*a* of the combustor 15. The rate of flow to the supply inlets can be controlled or cut off by burner control valves 70.

The combustor 15 will be started with oil supplied from an alternate fuel oil supply system 72 as its fuel. After sufficient coal dust is collected in the baghouse, it will be transported to the fuel metering pump bin from which it will be metered to the combustor. Thereafter, the alternate fuel oil supply system is cut out and the coal will be the sole source of fuel supply to the combustor.

The fuel flow to the combustor 15 is controlled to maintain a predetermined temperature at the dryer outlet. Toward this end, a temperature sensing means 71 in the dryer exhaust 3c operates to regulate a variable speed control 66b for the drive motor of the fuel supply conveyor 66, thereby controlling the rate of supply of fuel to the combustor 15. The gas temperature within the dryer must be high enough to prevent saturation of the gas but low enough for efficient heat transfer to the coal being dried. Accordingly the temperature of the combustion gas leaving the combustor can be controlled by the amount of tempering air entering the air bustle 18. Toward this end, a temperature sensing means 72 in the conduit 16 supplying hot gases from the combustor to the dryer is operatively connected to an actuator 53c which controls the valve 53b and to a variable speed control 19b for the tempering air fan 19a. As the temperature in the conduit 16 increases above a predetermined level more tempering air is supplied to the air bustle.

The combustion air splitter 56 in the conduit 55 maintains constant combustion air pressure for a set air flow rate. Toward this end, the temperature sensing means 71 in the dryer exhaust 3c also controls an actuator 56c which adjusts the valves 56a and 56b of the air splitter 56, one closing as the other opens and vice versa.

In this way, air from the cooler fan 54 not required for combustion will be used as tempering air. Also, clean exhaust air from the baghouse dust collector 30 can be recycled through the conduit 46 to the air bustle 18 in combination with or in lieu of the tempering air supplied by the fan 19. Recycling the warmed dryer exhaust gas will conserve heat in the system.

The flow of gas entering the dryer 3 is controlled by the pressure in the drying chamber 3a. Toward this end, a pressure sensing means 73 is reponsive to the pressure within the chamber 3a to regulate the variable speed control 28b for the drive motor 28a of the flow dryer exhaust fan. The speed of the dryer exhaust fan is adjusted to obtain the proper fluidization of the coal in the dryer, and the desired control is achieved by adjusting the speed of the fan 28 to compensate for changes in the pressure in the chamber 3a. Similarly, although not indicated, the rate of speed of the cooler fan 54 is controlled by the pressure within the chamber 11a of the cooler 11.

The control system of the present invention has provision for preventing condensation in the dryer exhaust system. Due to the high moisture content of the exhaust gas in the dryer discharge 3c and since the temperature leaving the dryer is within about 100° F. of the dew point, condensation could occur in the absence of preventive safeguards. The preventive safeguards to prevent condensation include utilizing the hot exhaust gas from the combustor 15 and bypassing the coal dryer to supply the necessary heat to the exhaust gas from the dryer 3. The hot exhaust gas from the discharge conduit 16 of the combustor is taken through a bypass which includes conduits 74 and 75 where they are tempered with recycled exhaust gas from the recycle conduit 46 through a valve 77.

The bypass control is provided by a valve 76 in the conduit 74. The valve 76 is controlled by an actuator 76a regulated by a temperature sensing means 78 in the conduit 74 downstream of the valve 76. The valve 77 which controls the supply of tempering fluid is regulated by an actuator 77a controlled by a temperature sensing means 79 in the conduit 75 downstream of the juncture of the conduits 74, 75. By reducing the temperature and oxygen content of the hot exhaust gas leaving the combustor through the conduit 74 and tempering it with recycled exhaust gas of low oxygen content from the baghouse dust collector 30, an atmosphere is created at the points where the hot gas in introduced into the dusty dryer exhaust system less conducive to heat dust explosion than if untempered gas from the combustor had been used.

The tempered hot gas from the combustor is added to the dryer exhaust gas stream at different points intermediate the dryer and the recycle fan 45, namely, immediately downstream of the dryer discharge 3c, intermediate the cyclone 22 and the baghouse dust collector and just upstream of the recycle fan 45. The first point of entry is through a conduit 82 which connects the conduit 75 through a valve 83 with the connecting passage between the dryer 3 and the cyclone 22. The valve 83 is regulated by an actuator 83a controlled by a temperature sensing means 84 in the exhaust conduit 27 from the cyclone 22. If the temperature in the conduit 27 falls below the predetermined level, it will open the valve 83 to increase the flow of tempered combustion gas to the dryer exhaust stream.

The second point of entry is via the conduit 75 to the conduit 29 leading to the baghouse dust collector. The introduction of tempered combustion gas is controlled by a valve 85 operated by an actuator 85a in response to a temperature sensing means 86 in the discharge conduit 41 from the baghouse dust collector.

A third point of entry is through a conduit 87 which connects the conduit 75 upstream of the valve 85 with the recycle conduit 43 upstream of the recycle fan 45. The flow through the conduit 87 is regulated by a valve 88 controlled by an actuator 88a which, in turn, is regulated by a temperature sensing means 89 in the conduit 46 upstream of the inlet 18b to the air bustle. The temperature sensing means 89 will detect a low temperature in the conduit 46 indicating that additional heat is required, and the valve 88 will be opened to supply the additional heat. By adding this protective heat supply to to the dryer exhaust gas stream at several points rather than at one point, there is less tendency to overheat the exhaust gas and less likelihood of an explosion.

Another safety feature of the coal dryer/cooler system is the ability to open the emergency tempering valve 31 in the event of high temperature in the baghouse dust collector 30 which might otherwise damage the filter bags. The valve 31 is operative by an actuator 31a in response to an excessively high temperature detected by the temperature sensing means 90 in the conduit 29 just upstream of the baghouse. Normally, the valve 31 remains closed.

The invention has been described in preferred forms and by way of example and many variations and modifications may be made within the scope of the invention. The invention, therefore, is not to be limited to any specified form or embodiment, except in so far as such limitations are expressly set forth in the claims.

We claim:

1. A coal drying apparatus comprising a coal dryer through which coal is fed in heat exchange relationship with a hot gas to heat the coal to a high temperature below the temperature which would bring about combustion, thereby removing moisture from the coal, a combustor for generating the hot gas supplied to the coal dryer, means for supplying the hot gas from the combustor to the coal dryer, a coal cooler through which the dried coal is fed in heat exchange relationship with ambient air to cool the coal quickly to slow the oxidation rate, said cooler having an inlet through which the coal is introduced from the dryer, an outlet from which the coal is discharged from the cooler and means defining a flow passage intermediate the inlet and outlet, means for introducing the ambient air into the cooler for flow through the coal in said flow passage, means for removing the dried and cooled coal from the cooler outlet as a useful product, and means for supplying the air heated in the cooler to the combustor.

2. A coal drying apparatus as set forth in claim 1 including a primary separator for receiving the hot gas discharged from the coal dryer and removing coal particles, means for returning the removed coal particles to the coal introduced into the cooler inlet, a secondary separator for receiving the hot gas from the primary separator and removing coal particles and means for supplying the coal particles removed from the secondary separator to the combustor for use as fuel.

3. A coal drying apparatus as set forth in claim 1 including separating means in communication with the hot gas discharged from the coal dryer and removing particles therefrom, means for supplying the hot gas from the coal dryer to the separating means, and means communicating with the combustor and bypassing the coal dryer for supplying hot gas discharged from the combustor to the gas downstream of the coal dryer to prevent condensation thereof.

4. A coal drying apparatus as set forth in claim 3 including means for recycling exhaust gas from the dryer to the combustor and means supplying some of the recycled gas to the bypass means for tempering the hot gas from the combustor.

5. A coal drying apparatus as set forth in claim 1 in which the coal dryer heats the coal to a temperature substantially above 100° F. and below 200° F. and in which the coal cooler quickly cools the coal to a temperature in the order of about 30° F. above the ambient temperature or lower.

6. A coal drying apparatus as set forth in claim 1 including a coal sprayer to spray the dried and cooled coal with a lubricant to reduce the oxidation rate further and to reduce the dusting of the coal.

7. A coal drying apparatus as set forth in claim 3 including means recycling exhaust gas from the dryer to the combustor and means supplying bypassed hot kiln gas from the combustor to the hot gas discharged from the coal dryer at a plurality of different points in its recycle passage from the coal dryer to the combustor so as not to excessively overheat the recycled gas.

8. A coal drying apparatus as set forth in claim 1 including a combustion chamber within the combustor, an air bustle in heat exchange relationship with the combustion chamber for cooling the combustion chamber and supplying air to complete combustion therein, air splitting means in the means for supplying air heated in the cooler to the combustor so that the heated air can be supplied directly to the combustion chamber, to the air bustle or apportioned therebetween, and valve means in the air splitter for controlling the apportionment.

9. A coal drying apparatus comprising a coal dryer through which coal is fed in heat exchange relationship with a hot gas to heat the coal to a high temperature below the temperature which would bring about combustion, thereby removing moisture from the coal, a combustor for generating the hot gas supplied to the coal dryer, means for supplying the hot gas from the combustor to the coal dryer, a primary separator for receiving the hot gas discharged from the coal dryer and removing coal particles which are returned to the dried coal, a secondary separator for receiving the hot gas from the primary separator and removing coal particles which are supplied to the combustor for use as fuel, means for recycling gas from the secondary separator back to the combustor and means bypassing the coal dryer for supplying hot gas discharged from the combustor to the hot gas downstream of the coal dryer.

10. A coal drying apparatus as set forth in claim 9 including a dryer exhaust fan intermediate the primary and secondary separators and in communication with the coal dryer through the primary separator to induce the flow of hot gas through the coal dryer and the primary separator and supply it to the secondary separator.

11. A coal drying apparatus as set forth in claim 10 including means for supplying air to the dryer exhaust gas supplied to the secondary separator in the event of an excessively high temperature to prevent damage to the secondary separator.

12. A coal drying apparatus as set forth in claim 9 including a plurality of means for introducing the hot gas bypassing the coal dryer into the gas discharged from the coal dryer and recycled to the combustor.

13. A coal drying apparatus as set forth in claim 9 including means supplying tempering gas from the recycled gas to the hot gas bypassing the coal dryer.

14. In a coal drying apparatus which includes a coal dryer through which coal is fed in heat exchange relationship with hot gas to heat the coal to remove moisture, a combustor for generating the hot gas supplied to the coal dryer, means for removing coal particles from the hot gas discharged from the coal dryer and means for recycling the gas exhausted from the dryer back to the combustor, the improvement of means for preventing condensation of the hot gas discharged from the coal dryer comprising a conduit bypassing the coal dryer and supplying hot gas discharged from the combustor to the gas discharged from the coal dryer.

15. A coal drying apparatus as set forth in claim 14 including a conduit communicating with the hot gas recycled to the combustor for supplying a tempering gas to said bypass conduit.

16. A coal drying apparatus as set forth in claim 14 including control means in said bypass conduit to regulate the flow therethrough and temperature sensing means in communication with the hot gas discharged from the coal dryer and located downstream of the point at which the bypass conduit communicates with the hot gas discharged from the coal dryer to regulate said control means in the bypass conduit.

17. A coal drying apparatus as set forth in claim 15 including control means for regulating the flow through the conduit which supplies the tempering gas to the hot gas which bypasses the coal dryer and temperature sensing means in communication with the tempered hot gas to regulate said control means in the conduit supplying the tempering gas.

18. A coal drying apparatus as set forth in claim 14 in which said means for removing coal particles from the hot gas discharged from the coal dryer includes a primary separator communicating with the gas discharged from the coal dryer, a secondary separator communicating with the gas discharged from the primary separator, means returning the coal particles recovered from the primary separator to the dried coal product discharged from the coal dryer and means for feeding the coal particles removed from the secondary separator to the combustor for supporting the combustion therein.

19. A method of drying coal in a coal dryer utilizing hot gas generated in a combustor and cooling the dried coal in a coal cooler having a flow passage intermediate an inlet and an outlet comprising feeding the coal through the coal dryer in heat exchange relationship with the hot gas generated in the combustor to heat the coal to a high temperature below the temperature which would bring about combustion, thereby removing moisture from the coal, supplying the hot gas from the combustor to the coal dryer, feeding the dried coal through the flow passage of the cooler from the inlet to the outlet, introducing ambient air into the cooler for flow through the coal in said flow passage, thereby cooling the dried coal in heat exchange relationship with the ambient air to cool the coal quickly to slow the oxidation rate, removing the dried and cooled coal from the cooler outlet as a useful product and supplying the air heated in the cooler to the combustor.

20. A method of drying coal as set forth in claim 19 including separating the larger coal particles from the gas discharged from the coal dryer and returning them to the dried coal and separating the finer coal particles and supplying them to the combustor for use as fuel.

21. A coal drying method as set forth in claim 19 including separating the particles from the hot gas discharged from the coal dryer, recycling the gas from which the particles have been removed to the combustor and supplying hot gas from the combustor, bypassing the coal dryer, to the gas discharged from the coal dryer to supply heat to prevent condensation.

22. A coal drying method as set forth in claim 21 including tempering the bypassed hot gas with recycled gas.

23. A coal drying method in which the coal is brought into heat exchange relationship with a hot gas generated in a combustor comprising feeding the coal through the dryer in heat exchange relationship with the hot gas generated in the combustor to heat the coal to a high temperature below the temperature which would bring about combustion, thereby removing moisture from the coal, separating the larger coal particles from the gas discharged from the coal dryer, returning the separated particles to the dried coal, separating the finer coal particles from the gas discharged from the coal dryer, supplying the finer coal particles to the combustor for use as fuel, recycling the gas from which the finer coal particles have been removed and returning it to the combustor and bypassing some of the hot gas discharged from the combustor to supply heat to the gas downstream of the coal dryer to prevent condensation.

24. A coal drying method as set forth in claim 23 including tempering the hot bypassed gas with some of the recycled gas.

25. In a coal drying method in which coal is fed through a coal dryer in heat exchange relationship with hot gas from a combustor to heat the coal to remove moisture and particles are removed from the gas discharged from the coal dryer before it is recycled back to the combustor, preventing condensation of the gas discharged from the coal dryer, the improvement comprising supplying hot gas discharged from the combustor, bypassing the coal dryer, to the hot gas discharged from the coal dryer at at least one point downstream of the coal dryer and upstream of the combustor.

26. In a coal drying method as set forth in claim 25 including tempering the hot gas bypassing the coal dryer with some recycled gas.

27. A coal drying method as set forth in claim 25 including controlling the flow of hot gas bypassing the coal dryer in response to the temperature of the hot gas downstream of the point at which the hot gas bypassing the coal dryer is supplied to the gas discharged from the coal dryer.

28. A coal drying method as set forth in claim 26 including controlling the supply of recycled tempering gas supplied to the hot gas in response to the temperature of the tempered, hot gas downstream of the point at which the tempered gas is supplied to the hot gas.

* * * * *